United States Patent [19]

Kobler

[11] Patent Number: 4,602,774

[45] Date of Patent: Jul. 29, 1986

[54] APPARATUS TO RECEIVE FOLDED PAPER PRODUCTS

[75] Inventor: Ingo Kobler, Anhausen, Fed. Rep. of Germany

[73] Assignee: M.A.N-Roland Druckmaschinen Aktiengesellschaft, Offenbach am Main, Fed. Rep. of Germany

[21] Appl. No.: 761,048

[22] Filed: Jul. 31, 1985

[30] Foreign Application Priority Data

Aug. 2, 1984 [DE] Fed. Rep. of Germany ..... 3428512

[51] Int. Cl.[4] ..... B65H 5/30

[52] U.S. Cl. ..... 270/54; 198/476.1; 198/486.1; 198/627; 271/69

[58] Field of Search ..... 270/45, 54–58; 198/476.1, 486.1, 627, 644; 271/69

[56] References Cited

U.S. PATENT DOCUMENTS

| | | | |
|---|---|---|---|
| 1,279,796 | 9/1918 | Walser | 198/644 |
| 3,479,932 | 11/1969 | Stal et al. | 198/644 X |
| 3,526,170 | 9/1970 | Oderman et al. | 271/69 |
| 4,526,356 | 1/1985 | Swint | 270/57 |

*Primary Examiner*—E. H. Eickholt

*Attorney, Agent, or Firm*—Frishauf, Holtz, Goodman & Woodward

[57] ABSTRACT

To pick up folded paper sheets, being folded, for example, by a standard folding apparatus (1, 2, 4-6), an endless transport belt or chain (71; 7, 7, 7', 18) retains thereon carrier elements (9) made of highly elastic flat spring steel, being guided by the endless transport means in a path which places the flat spring steel strips edgewise between the folding products at the folding zone, then transport the folded products along the path and then decelerates the folded products while spreading them apart. The latter combined effect is obtained by guiding the transport means over a deflection wheel (11, 16) at the region of attachment of the carrier elements to the transport chain or belt, while retaining the flat strip free end portions, forming hangers, at or close to the center of rotation of the deflection wheel, so that, effectively, the folded paper products will be spread while, at the same time, will be slowed, or have a linear speed of, or close to 0.

18 Claims, 10 Drawing Figures

Fig. 2
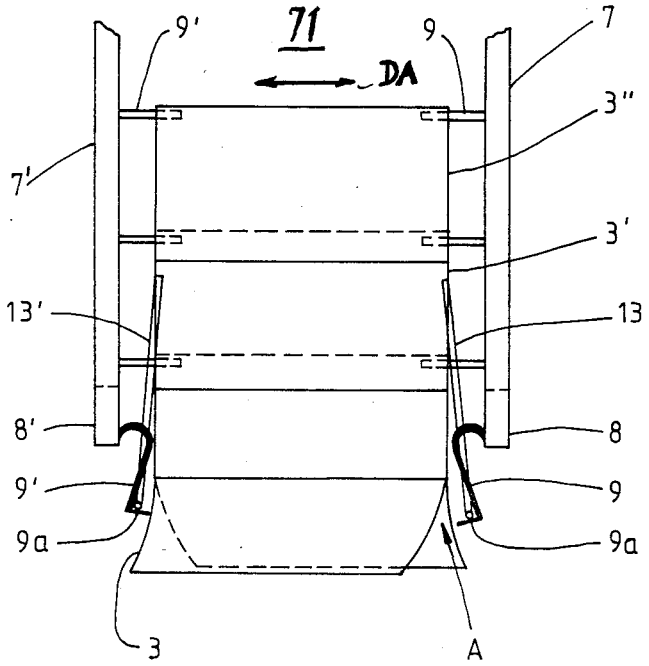
Fig. 3
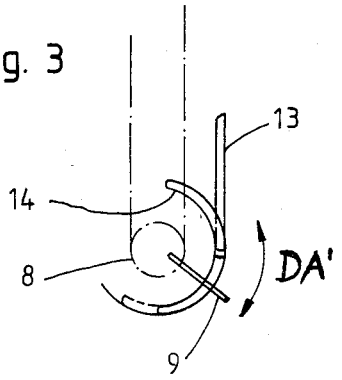
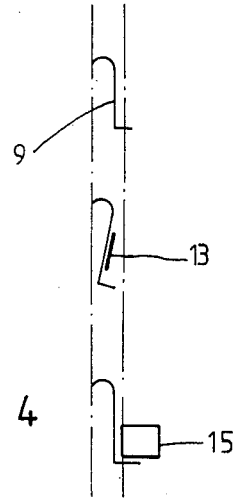
Fig. 4

APPARATUS TO RECEIVE FOLDED PAPER PRODUCTS

Reference to related application, assigned to the assignee of the present invention, the disclosure of which is hereby incorporated by reference: U.S. Ser. No. 756,779, filed July 18, 1985, HECHLER. German Pat. No. 21 36 227; German Pat No. 31 42 242.

The present invention relates to paper handling apparatus, and more particularly to apparatus which is adapted to work together with a printing machine to receive folded papers which are folded in a folding apparatus, and to continue to transport the folded paper products via a continuously operating endless transport device to remote locations and/or for association of additional paper products therewith.

BACKGROUND

It has previously been proposed—see for example German Pat. No. 21 36 227—to fold papers and then, in order to permit the addition of inserts, to open the folded paper products by means of a separating element. A typical application is the introduction of inserts into already folded paper materials, such as newspapers. In accordance with various structures, of which the German Pat. No. 21 36 227 is representative, a separate apparatus is needed in order to re-open the folded paper products. This increases the cost of the overall apparatus and, hence, increases the cost of handling of the paper products and renders the entire system more complex.

Various types of folding apparatus are known and customary in the printing and paper handling field. German Pat. No. 31 42 242 describes a system in which a folding flap cylinder is used which cooperates with a folding blade cylinder which, simultaneously, also may be a collection cylinder. The fold is formed in this way: A sheet, or a group of superimposed sheets, or a package of sheets, is placed on the folding blade cylinder and the folding blade, which is controllably located on the folding blade cylinder, pushes the sheet or package of sheets at an intermediate position in an opened folding flap of the folding flap cylinder. A rotating transport device, for example a bucket wheel, then removes the now folded paper products from the folding apparatus.

Another type of folding apparatus is known, referred to as a drum folding apparatus. Rather than using a folding flap cylinder and a folding blade cylinder, a pair of folding rollers are used, between which a folding blade can be inserted in order to push sheets or a package of sheets between the folding rollers which, then, continue to grip the folded sheet or package of sheets and transport the now folded sheet or package of sheets in the nip between the two folding rollers or drums.

THE INVENTION

It is an object to provide a folded paper product receiving apparatus in which a separate apparatus to open already folded sheets is not needed, so that the opportunity presents itself to collect the folded paper products separately, or, for example, to collect folded products within each other, for example to provide inserts, or to otherwise handle the folded paper products. In such apparatus, it is necessary to change the transport speed of the folded products, and it is an object of the invention to permit such change of transport speeds essentially without use of additional devices or apparatus components.

Briefly, an endless transport element, such as a transport chain or the like, is provided, on which elastic carrier elements, for example in the shape of flat spring brackets, are attached. The flat spring brackets are attached at one end to the transport means, typically a chain, the free end portion being angled off and adapted to engage within the folded paper products. The folded paper products, being carried by the transport chain and suspended on the angled portions of the spring holding brackets, are carried over a guide wheel which is introduced in the path of the transport means, for example a chain, in such a manner that the center of rotation of the guide wheel is approximately or close to or in the vicinity of the angled-off portion of the elastic, springy carrier elements, formed by the carrier brackets. By this arrangement, namely by positioning the deflection wheel with its center of rotation at or in the vicinity of the end portions of the carrier elements, the transport path will include a loop of about at least a major portion of the circumference of the deflection wheel and, upon passage of the engagement elements, or, rather, the angled ends thereof, the angled free end portions will only have to travel over a much shorter path, or none, depending on the distance of the free angled-off end portions from the center of rotation of the deflection wheel so that the free end portions, and with them the paper products suspended thereon, will have a very low speed, down to speed zero. In other words, the angled-off end portions of the elastic carrier elements, on which the folded products are suspended by their folds, will travel only about a very small radius of the deflection wheel, or none. The rotation of the elastic carrier elements, however, particularly when they are flat, will cause the products to open or spread apart about the fold line, so that the ooject of slowing the paper products, while spreading them apart, for example to permit insertion of additions or supplements, is achieved.

The system and apparatus of the present invention is suitable with various types of folding apparatus, and specifically with the folding apparatus which uses a folding flap cylinder and a blade cylinder on the one hand, and with the folding apparatus which uses a pair of folding rollers and a reciprocating blade on the other. The adaptation of the system of the present invention to any one of the folding apparatus is a simple matter.

DRAWINGS

FIG. 2 is a fragmentary front view of the apparatus;

FIG. 3 is a fragmentary highly schematic view of a deflection arrangement suitable in the apparatus of FIG. 2;

FIG. 4 is a schematic illustration showing the temporal course of deflection of the elastic carrier elements;

DETAILED DESCRIPTION

Figure 1:
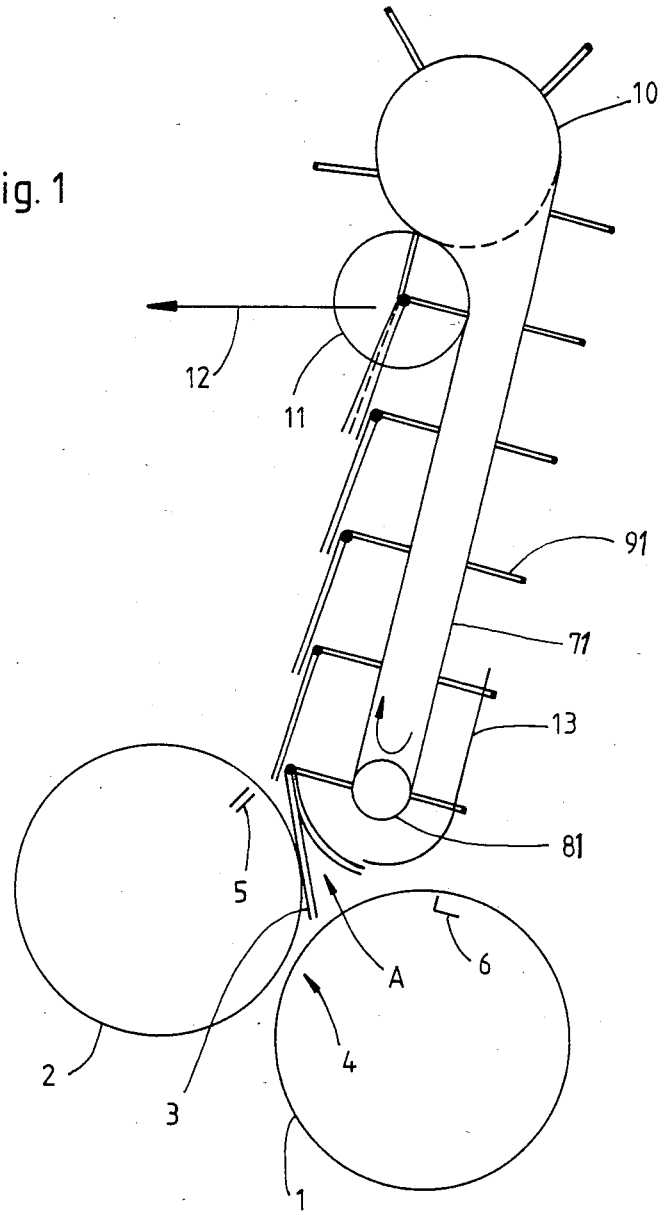
FIG. 1 is a schematic side view of the apparatus, omitting all matters not necessary for an understanding of the invention.
Figure 5:
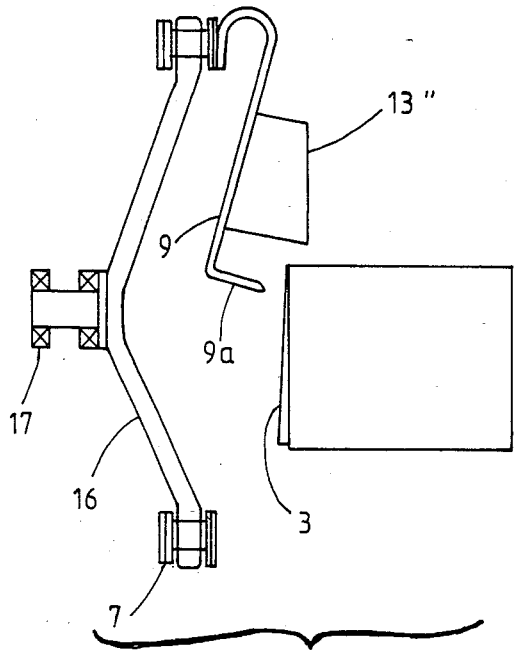
FIG. 5 is a fragmentary illustration of the apparatus showing specfically the deflection wheel and the arrangement to reduce the linear transport speed of the folded paper product.

FIG. 1 shows, schematically, a folding system which includes a folding blade cylinder 1 which, simultaneously, may function as a collection cylinder, and a folding flap cylinder 2, cooperating with the folding blade cylinder 1. Sheets or packages of sheets which typically have been printed in one or multiple colored ink, are pushed at the transfer position 4, as well known, in opened folding flaps 5 formed on the folding flap cylinder 2. The folding blade cylinder 1 has folding blades 6 thereon, shown only schematically, which, at the appropriate time, project to fold sheets on the cylinder 1 at an intermediate, for example central point into the flaps 5. The location above the cylinders 1, 2 forms an approximately triangular zone A which is located at and behind the transfer position 4. This zone A may also be referred to as a pinch zone. At this instant in time—during rotation of the cylinders—both halves of the folded products 3 are still on the folding blade cylinder 1.

The pinch zone A will occur not only in the folding blade—folding flap cylinder arrangement as illustrated, but also between a pair of folding rollers between which a sheet or group of sheets or package of sheets to be folded is pushed by a folding blade. The apparatus in accordance with the present invention thus may be used not only with the particular type of cylinders 1, 2 described, but also with the folding apparatus in which a pair of folding rollers catch, between a nip of the rollers, the folded sheets or sheet packages. It is only necessary, then, to form appropriate recesses or grooves at the circumference of the respective rollers so that the carrier elements can be accomodated.

Figure 6:
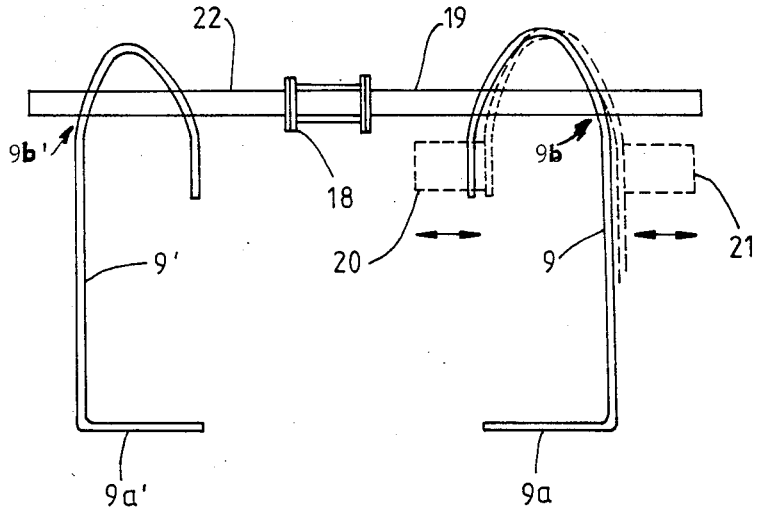
FIGS. 6 to 8 show, schematically, side views of attachment arrangements of the carrier elements to a transport chain or belt.
Figure 7:
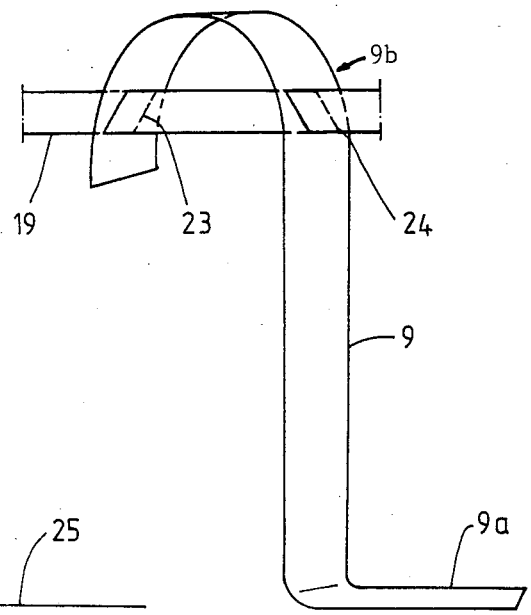
Figure 8:
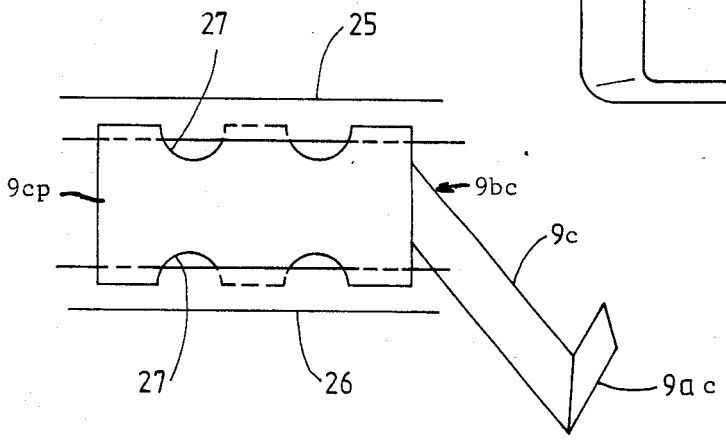

In accordance with the present invention, an endless transport system 71 is provided which, for example, may be a sprocket chain or a sprocket belt or toothed belt. The transport system 71 is guided about a return wheel 81 which is located above the wedge-shaped pinch zone A. The transport system 71 has elastic or yielding deflectable carrier elements 9 secured thereto. The carrier elements 9 are made, preferably, of highly elastic spring steel and, looked at from the side, have a shape which is best seen in FIGS. 6 to 8. The elastic carrier elements 9 pull off the folded paper products 3 from the cylinders 1, 2 with a speed which is higher than the circumferential speed of the cylinders. Consecutive sheets or sheet packages 3 are then transported by the transport system 71, for example in imbricated arrangement, in such a manner that the linear speed of the elements is reduced. Subsequent to the pull-off of the folded products 3 from the cylinders 1, 2, at increased speed, and to the following decelaration, a straight zone or region of the transport path will be entered. By guidance of the transport system 71 about a deflection wheel 11, the linear speed of the folding products 3 can be readily decreased down to a speed zero. This is obtained by guiding the system 71 such that angled-off ends of the carrier elements 9 will be approximately concentric with the center of rotation of the deflection wheel 11. If the center of rotation of the deflection wheel 11 and the angled-off portions 9*a* (FIGS. 2, 6, 7) coincide, the linear speed of the folded products will become zero. The speed of the folding products, thus, can be readily arranged by placing the angled- off ends of the carrier elements, which function as hangers, to be located at a radius which is small with respect to the circumferential or maximum radius of the deflection wheel 11. At this moment, that is, at relatively slow speed or actual stop of the angled-off portions of the elastic carrier elements, the folded paper products can be transferred to a further transport system, as well known, and hence as shown only by the arrow 12, schematically, in FIG. 1. Transfer apparatus of this type are described in greater detail in the referenced application Ser. No. 756,779, filed July 18, 1985, HECHLER. Thereafter, the transport system 71 is guided about a further upper return wheel 10, which will turn around the elastic carrier elements and carry them downwardly in direction towards the lower wheel 8 to receive a further folded paper product, or package of products.

Details of the arrangement are best seen with reference to FIGS. 2–5: The transport system 71 preferably includes a pair of transport belts, sprockets, or the like, shown schematically at 7, 7' in FIG. 2, and positioned, preferably, at both sides of the transport path ot the folded products. The two belts or sprockets 7, 7' are guided above the wedge-shaped zone A about wheels 8, 8'. At that point, the angled-off ends 9*a*, 9*a'* of the elastic carrier elements 9, 9' obtain an increase in speed, since they are changed from a straight-line movement about the arc of the wheel 8, 8', respectively. At the transition from the straight-line to the curved path, the linear speed of the ends 9*a*, 9*a'* will increase. The spacing, that is, the width of the endless transport belts or similar means 7, 7' may be made variable in order to accomodate various widths of folded products—see double arrow DA.

The wheel 8 is preferably so positioned that the increase in speed of the angled-off end portions 9*a*, 9*a'* starts after the ends engage in the still open halves of the folded products 3 in the region A. Thus, the folded products 3 can be pulled off from the folding blade cylinder 1 after the folding flaps 5 of course have previously opened. Normally, the carrier elements which are made of highly elastic material, are secured to the transport belts or chains 7 when they are in relaxed condition. At a predetermined position, and in good time before the carrier elements 9 reach the vicinity of the roller 8, a stationary deflection or tensioning device, for example in form of a deflection rail or cam 13, engages the deflection elements 9 so that the angled-off end portions 9*a*, 9*a'* are deflected outwardly—see FIG. 2. In this position, they are tensioned. After the elements travel past the deflection rails, the tensioned elements again are permitted to relax so that the end portions 9*a*, 9*a'* can move inwardly, with their narrow edge fitting in the region A between the still somewhat open halves of the folded products 3.

If necessary, and particularly if the entire system is to operate at high speed, the release of the carrier elements 9 can be placed ahead, so that they can relax comparatively early in an inward direction, that is, in the direction of the folded product. It is also possible to use a positive guidance for the elements in the path described. The ends 9*a*, 9*a'* engage at comparatively high speed between the opened halves of the folded products 3 in the zone A. A variable deflection or tensioning arrangement may be used, as illustrated, for example, in FIG. 3, which is adjustable. A curvilinear or bent deflection element is used besides the stationary deflection rail 13. As indicated by the double arrow DA' of FIG. 3, the deflection rail 14 can be moved about the circumference of the wheel 8, so that the deflection element 14, in practical effect, provides for an extension of the deflection rail 13 in the wedge-shaped zone A. The instant of time, or the location in which the tensioned carrier elements 9 are released can thus be individually set and adjusted.

In accordance with a preferred feature of the invention, oscillations which result after release of the tensioned carrier elements 9, which may also be termed brackets or holders, the inner side of the path of the carrier elements 9, 9' may be supplied with damping elements 15—see FIG. 4. Various types of damping elements can be used which may be arranged separately or together along the path; the damping elements may be made of elastic material, such as rubber or plastic, or may include a magnet. Damping elements may be located on one or on both sides of the deflection elements so that the oscillations are readily suppressed. FIG. 4 shows a developed path of the elements 9, in which the movement of the elements is downwardly with respect to FIG. 4.

The folded products which are pulled off by the elements 9, 9' or, rather, by the angled-off ends 9*a*, 9*a'*, from the cylinders 1, 2 at high speed are then reduced in speed, while forming an imbricated or scaled arrangement. The folded products 3, thus, are then carried at a somewhat slower speed linearly along the transport path of the transport arrangement 71. The path extends, essentially linearly, to the deflection wheel 11. The transport path of the transport device 71 is so changed by the deflection wheel 11 that the outwardly projecting ends 9*a*, 9*a'*, of the carrier elements run about the deflection wheel 11 in a position on or close to the center of the deflection wheel 11. This results in a further reduction of the linear speed of the folded products 3. If the turning point of the ends 9*a*, 9*a'* of the carrier elements 9 is placed precisely in the center of the deflection wheel 11, a speed 0 for the folded products 3 will result as the transport path 71 extends about the deflection wheel 11. This slow or stopped speed permits ready transfer of the folded products to additional transport systems for further handling.

The temporal course of the transport path is shown in FIG. 4, in which, also, deflection of the carrier elements 9 by the rail 13 is shown, as well as relaxation of the resilient carrier elements, and, to dampen oscillations, the damping element 15.

Figure 9:
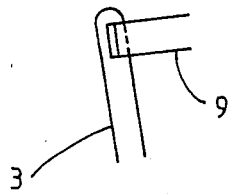
FIGS. 9 and 10 are schematic illustrations showing how the folded paper products are spread upon rotation of the carrier elements as they pass over the deflection wheel.
Figure 10:
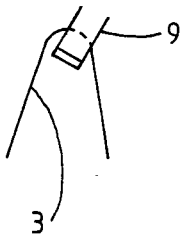

The carrier elements are preferably spring steel, for example flat spring steel elements, and are secured with one end to the transport chains or belts 7, 7'. As the elements are guided about the deflection wheel 11, they will automatically rotate within the folded products 3, resulting, at the same time, in automatically spreading the folded products 3—compare FIGS. 9 and 10. The barrier, in the region A, with the angled-off ends 9*a*, 9*b*, is introuuced into the folded products 3 with the narrow edge facing the fold—see FIG. 9. Upon deflection about wheel 11, the edge 9 will turn within the folded product —see FIG. 10. Transfer to further transport systems is thus substantially facilitated.

Transfer of the paper products at a transfer position—see the arrow 12, FIG. 1—is further facilitated by utilizing a concave or dished or cupped deflection wheel 11. The concave shape is shown for wheel 16, FIG. 5, which in this example is a sprocket wheel. The wheel 11, FIG. 1, may utilize the sprocket wheel 16 of FIG. 5 and a further deflection element 13'' (FIG. 5) can be used in order to deflect the carrier elements 9—as well as the elements 9', not shown in FIG. 5—outwardly, so that the ends 9*a*, 9*a'* will be removed from the paper products 3—see FIG. 5. Spreading the elements 9 outwardly preferably is carried out after the folded products 3 have been threaded on, or received by, a subsequent transport system, not shown. Reference is here made to the referenced application Ser. No. 756,779, HECHLER.

Referring to FIGS. 6 to 8: FIG. 6 to 8 show preferred embodiments of elastic carrier elements, and attachment of the carrier elements to a transport system, in accordance with a feature of the present invention. The carrier elements 9, 9'—see FIGS. 6 and 7—may be formed with openings 23, 24, through which a cross bar or cross rod 19 can be inserted once the upper end portions 9*b* of the carrier elements are bent into U-shaped configuration, see FIG. 7. The cross bar 19, in turn, is attached to an endless transport system, for example a central chain 18 which is guided in the transport path about the wheels 8, 10, and the deflection wheel 11. The spacing of the carrier elements 9, 9' is readily adjusted, and can be automatically controlled by engaging one, or both of the carrier elements by shift rollers 20, 21 (FIG. 6) which engage the upper portion 9*b*, 9*b'*, respectively, of the carrier elements 9, 9' by compressing the U-shaped legs towards each other and thus permit lateral shifting of the carrier elements 9, 9' on the respective halves of the cross rod 19; only one half, that is, the half portion 22, is identified in FIG. 6. This shifting arrangement or provision can be automated. FIG. 6 shows the left half 22 of the cross rod 19, the adjustment being shown, however, only with respect to the right half.

FIG. 8 illustrates another embodiment of the present invention, in which a carrier element 9*c* is shown, having end portions 9*ac* and 9*bc*, respectively. The end portion 9*bc* is extended to form a resilient plate portion 9*cp* which is formed with punched-out openings 27, the plate portion 9*cp* being threaded on two parallel rods 25, 26 which, in turn, are coupled to an endless transport system. Preferably, the endless transport system may again be a transport sprocket chain like chain 18 of FIG. 6, to which the parallel rods 25, 26 are attached. The plate 9*cp* is deflected or bent into undulating form to thus retain the carrier element 9*c* on the cross rods 25, 26 and hence on the transport system 71. The position of the carrier element 9*c* with respect to the transport chain can thus be readily changed, and the spacing of the carrier elements from each other, engaging on opposite sides of the folded products 3, can be matched to the width of the folded products.

In accordance with a preferred form of the invention, suitable chain guides are provided to facilitate the transition of direction of the chain from the curved to a straight path and to insure that this transition will be without jolts or deviation from smooth operation.

Various changes and modifications may be made, and features described in connection with any one of the embodiments may be used with any of the others, within the scope of the inventive concept.

I claim:

1. In combination with a paper goods folding device (1, 2, 4–6) defining a folding zone (A) and a further paper product transport device (12), apparatus to receive and transport folded paper products (3)

comprising, in accordance with the invention, an endless transport means (71; 7, 7', 18);

elastic carrier elements (9, 9*c*) positioned along the transport means, and spaced from each other, said carrier elements having an attachment region (9b) at which each carrier element is attached to the transport means and an angled free end portion (9a, 9a', 9ac) adapted to engage in the fold of the paper products;

deflection means (13, 14) positioned ahead—in the direction of movement of the transport means—of the folding zone and engageable with the carrier elements to spread the angled free end portion (9a) of the carrier elements resiliently away from the fold of the folded paper products and outside of the lateral limits or edges thereof, said deflection means permitting the angled free end portions (9a) to engage in and between the fold of the folded paper products (3) and thereby transport the paper products away from the folding zone (A) and at the speed of operation of the transport means (71; 7, 7', 18);

guide wheel means (81, 8, 8'; 11, 10) coupled to the transport means and guiding the transport means in a transport path which includes said folding zone, said guide wheel means including a deflection wheel (11) positioned with its center of rotation at or in the vicinity of the end portions (9a) of the carrier elements being transported by the transport means, said transport path including a loop of about at least a major portion of the quarter circumference of the deflection wheel (11) so that, upon passage of the attachment regions (9b) of the carrier elements, coupled to the transport means, about the deflection wheel, the angled free end portions (9a) and the folds of the paper products engaged thereby, will have a lower speed, down to speed 0, due to travel about a smaller radius than the circumference of the deflection wheel (11);

and means for spreading the folded products (3) for transfer thereof to the further transport device (12).

2. Apparatus according to claim 1, wherein the transport elements comprise flat spring steel elements;

and the means for spreading for speading the folded products comprises the interaction of the guidance of the elastic flat carrier element about at least a major portion of the quarter circumference of the deflection wheel (11) at the attachment region (9b) resulting in twist of the angled free end portions (9a) of the flat spring steel elements from a position parallel to the fold of the folded paper products (3) to a position transverse of the fold.

3. Apparatus according to claim 1, wherein the deflection means comprises an adjustable deflection element (14), adjustably positionable in an arcuate path (DA) extending in a direction of the folding zone.

4. Apparatus according to claim 1, wherein the elastic carrier elements (9, 9c) comprise highly elastic spring steel strips.

5. Apparatus according to claim 1, wherein the endless transport means comprises two endless transport belts or chains located laterally adjacent the respective folded products (3).

6. Apparatus according to claim 1, wherein the deflection wheel (11) comprises a concave or dished wheel.

7. Apparatus according to claim 1, wherein the endless transport means comprises a central endless transport belt or chain (18);

and a plurality of cross rods (18; 25, 26) secured to the belt or chain and extending transversely thereof, the elastic carrier elements (9, 9c) being secured to respective cross rods laterally of the chain or belt.

8. Apparatus according to claim 7, wherein (FIGS. 6, 7) the attachment regions (9b) of the elastic carrier elements are bent into U shape and formed with aligned openings through which a cross rod (19) is threaded.

9. Apparatus according to claim 7, wherein each carrier element has two cross rods (25, 26) associated therewith, the attachment regions of the elastic carrier elements being formed with recesses or notches (27) threaded on the parallel cross rods in undulating arrangement.

10. Apparatus according to claim 7, further including position adjustment elements (20, 21) engageable with the elastic carrier elements and shifting the position of the elastic carrier elements on the cross rods to adjust the spacing of the angled free end portions (9a) of the carrier elements from the central chain or belt.

11. Apparatus according to claim 8, further including positioning elements engageable with the U-shaped attachment region of the carrier elements and located to compress the attachment region to permit shifting of the attachment region on the respective cross rod (19).

12. Apparatus according to claim 1, further including a vibration or oscillation damping means (15) located along the transport path on at least a portion thereof and in the vicinity of the folding zone (A) to dampen oscillations or vibrations of the elastic carrier elements after release from the deflection means.

13. Apparatus according to claim 12, wherein the damping means comprises an elastic element.

14. Apparatus according to claim 12, wherein the damping means comprises a magnetic element.

15. Apparatus according to claim 1, wherein the endless transport means comprises two parallel chains or belts, the spacing of the parallel chains or belts (7, 7') being adjustable (DA).

16. Apparatus according to claim 1, wherein the elastic carrier elements comprise flat strips secured to the endless transport means, projecting from the transport means the direction of projection of the flat strips from the transport means remaining fixed with respect to the transport means regardless of the direction of travel of said transport means to change the direction of the flat surface of said flat strips as a function of the direction of the path of the transport means.

17. Apparatus according to claim 16, wherein the transport path is arranged to place the flat strips between the fold of the folded products upon acceptance of the folded products in said folding zone, transport the folded products suspended from an edge of the flat strips, and then, upon guidance of the transport means about the deflection wheel, rotate the flat strips within the fold of the folded products, thereby spreading the folded products apart.

18. Apparatus according to claim 17, wherein the flat strip of the carrier element comprises at least the free end portion (9a) thereof.

* * * * *